US008449272B2

(12) United States Patent
Hahn

(10) Patent No.: US 8,449,272 B2
(45) Date of Patent: May 28, 2013

(54) SEALED COMPRESSOR WITH EASY TO ASSEMBLE OIL PUMP

(75) Inventor: Gregory W. Hahn, Arkadelphia, AR (US)

(73) Assignee: Danfoss Scroll Technologies LLC, Arkadelphia, AK (US)

( * ) Notice: Subject to any disclaimer, the term of this patent is extended or adjusted under 35 U.S.C. 154(b) by 463 days.

(21) Appl. No.: 12/780,186

(22) Filed: May 14, 2010

(65) Prior Publication Data

US 2011/0280749 A1 Nov. 17, 2011

(51) Int. Cl.
*F04B 17/00* (2006.01)
*F04B 35/04* (2006.01)

(52) U.S. Cl.
USPC ..... 417/410.5; 418/88

(58) Field of Classification Search
USPC .... 417/410.5; 184/6.16, 6.13, 6.18; 418/55.6, 418/55.1–55.5, 83–100
See application file for complete search history.

(56) References Cited

U.S. PATENT DOCUMENTS 4,585,403 A * 4/1986 Inaba et al. ..... 418/55.5
5,176,506 A * 1/1993 Siebel ..... 417/368
5,591,018 A * 1/1997 Takeuchi et al. ..... 417/366
6,196,814 B1 * 3/2001 Cooksey et al. ..... 418/32
6,247,909 B1 * 6/2001 Williams et al. ..... 418/55.1
6,457,562 B1 * 10/2002 Sun ..... 184/6.16
6,560,868 B2 * 5/2003 Milliff et al. ..... 29/888.022
6,695,201 B2 * 2/2004 Narasipura et al. ..... 228/245
7,442,018 B2 * 10/2008 Kiyokawa et al. ..... 418/88
7,494,329 B2 * 2/2009 Yoo et al. ..... 418/88
7,632,081 B2 * 12/2009 Yoo et al. ..... 418/88
7,717,688 B2 * 5/2010 Yoo et al. ..... 418/88
8,043,079 B2 * 10/2011 Yoo et al. ..... 418/88
8,177,525 B2 * 5/2012 Takahashi et al. ..... 417/373
2002/0100638 A1 * 8/2002 Sun ..... 184/6.16
2003/0039562 A1 * 2/2003 Narasipura et al. ..... 417/410.5
2005/0025650 A1 * 2/2005 Hsia ..... 418/55.1
2007/0071627 A1 * 3/2007 Lee et al. ..... 418/55.6
2007/0160489 A1 * 7/2007 Yoo et al. ..... 418/88
2009/0139262 A1 * 6/2009 Takahashi et al. ..... 62/468
2010/0083690 A1 * 4/2010 Sato et al. ..... 62/470
2011/0085925 A1 * 4/2011 Fan et al. ..... 417/321

* cited by examiner

*Primary Examiner* — Devon Kramer
*Assistant Examiner* — Christopher Maxey
(74) *Attorney, Agent, or Firm* — Carlson, Gaskey & Olds, PC

(57) ABSTRACT

A sealed compressor has a lower end cap secured to a center shell, and defines a sealed chamber. An electric motor is received within the sealed chamber. The electric motor drives a shaft that drives a compressor pump unit. A lower bearing housing includes a bearing for supporting the shaft, and an oil pump. The oil pump includes a pump housing including one of a slot and a leg, with the bearing housing including the other of a slot and a leg. The leg is received in the slot to position the pump housing within the bearing housing. The oil pump further includes a piston to be driven by the shaft to drive the lubricant from a sump in the sealed chamber upwardly into a passage in the shaft.

17 Claims, 4 Drawing Sheets

SEALED COMPRESSOR WITH EASY TO ASSEMBLE OIL PUMP

BACKGROUND

This application relates to a sealed compressor, wherein an oil pump is provided in a lower bearing housing, and the oil pump is easy to assemble.

Sealed compressors are known, and typically include a hermetically sealed shell secured to a lower end cap. A motor is mounted within the shell, and serves to drive a rotary shaft. The rotary shaft typically drives a pump unit for the compressor. Any number of distinct pump units may be utilized.

Oil is required at a number of sliding and rotating surfaces within the sealed compressor. One standard way of supplying oil to the compressor pump unit, is through a central passage in the rotary shaft. Often, an oil pump is provided in a lower portion of the sealed compressor, to deliver oil upwardly through the central passage.

In the past, the oil pumps have been difficult to assemble.

SUMMARY

A sealed compressor has a lower end cap secured to a center shell, and defines a sealed chamber. An electric motor is received within the sealed chamber. The electric motor drives a shaft that drives a compressor pump unit. A lower bearing housing includes a bearing for supporting the shaft, and an oil pump. The oil pump includes a pump housing including one of a slot and a leg, with the bearing housing including the other of a slot and a leg. The leg is received in the slot to position the pump housing within the bearing housing. The oil pump further includes a piston to be driven by the shaft to drive the lubricant from a sump in the sealed chamber upwardly into a passage in the shaft.

These and other features of the present invention can be best understood from the following specification and drawings, the following of which is a brief description.

DETAILED DESCRIPTION

Figure 1:
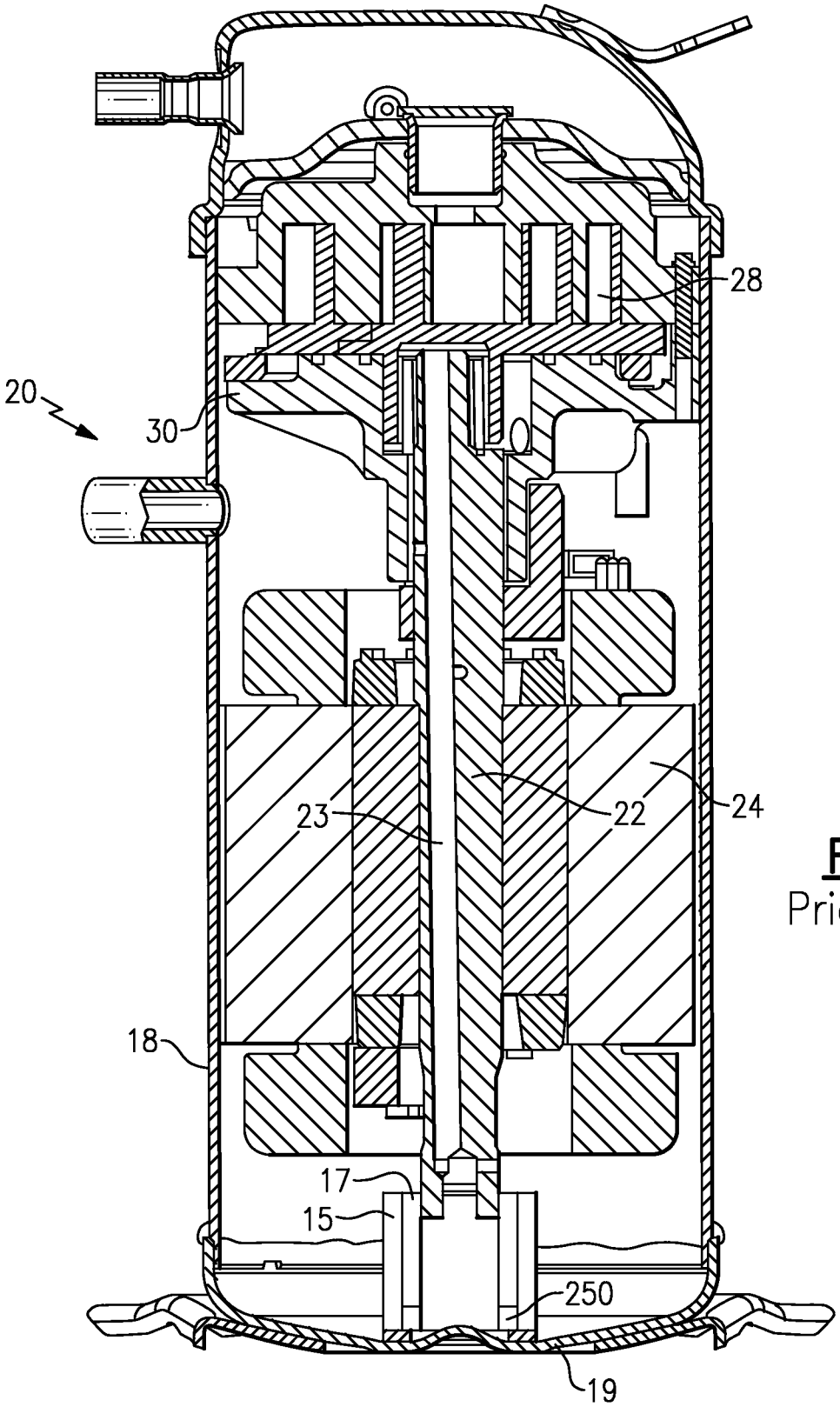
FIG.1 Prior Art
FIG. 1 shows a known sealed compressor.

A compressor unit 20 is illustrated in FIG. 1. A center cylindrical shell 18 is secured to a lower end cap 19. Lower end cap 19 includes a bearing housing 26 which mounts a remote end of a shaft 22. The shaft 22 is provided with a central passage 23. As known, oil is delivered upwardly through the central passage and to sliding surfaces, such as may be found between the components of a compressor pump unit 28, and crankcase 30. A motor 24 serves to drive the shaft 22 to rotate. As shown, a bearing housing 15 mounts a bearing 17 to support shaft 22. The structure is shown somewhat schematically. Further, an oil pump 250, shown entirely schematically, is typically included at this location. However, the known oil pumps have included housings which require bolts, etc. to be mounted within the bearing housing 15.

The compressor pump unit 28 as illustrated in FIG. 1 is a scroll compressor including an orbiting scroll member interfitting with a non-orbiting scroll member. However, other types of compressor pump units can be utilized within a sealed compressor.

The known sealed chambers included an oil reservoir, such that oil will be delivered by the oil pump upwardly into the shaft. The inventive structure as shown in FIGS. 2-5 would be incorporated into a compressor as illustrated in FIG. 1, which would also include such an oil sump.

Figure 2:
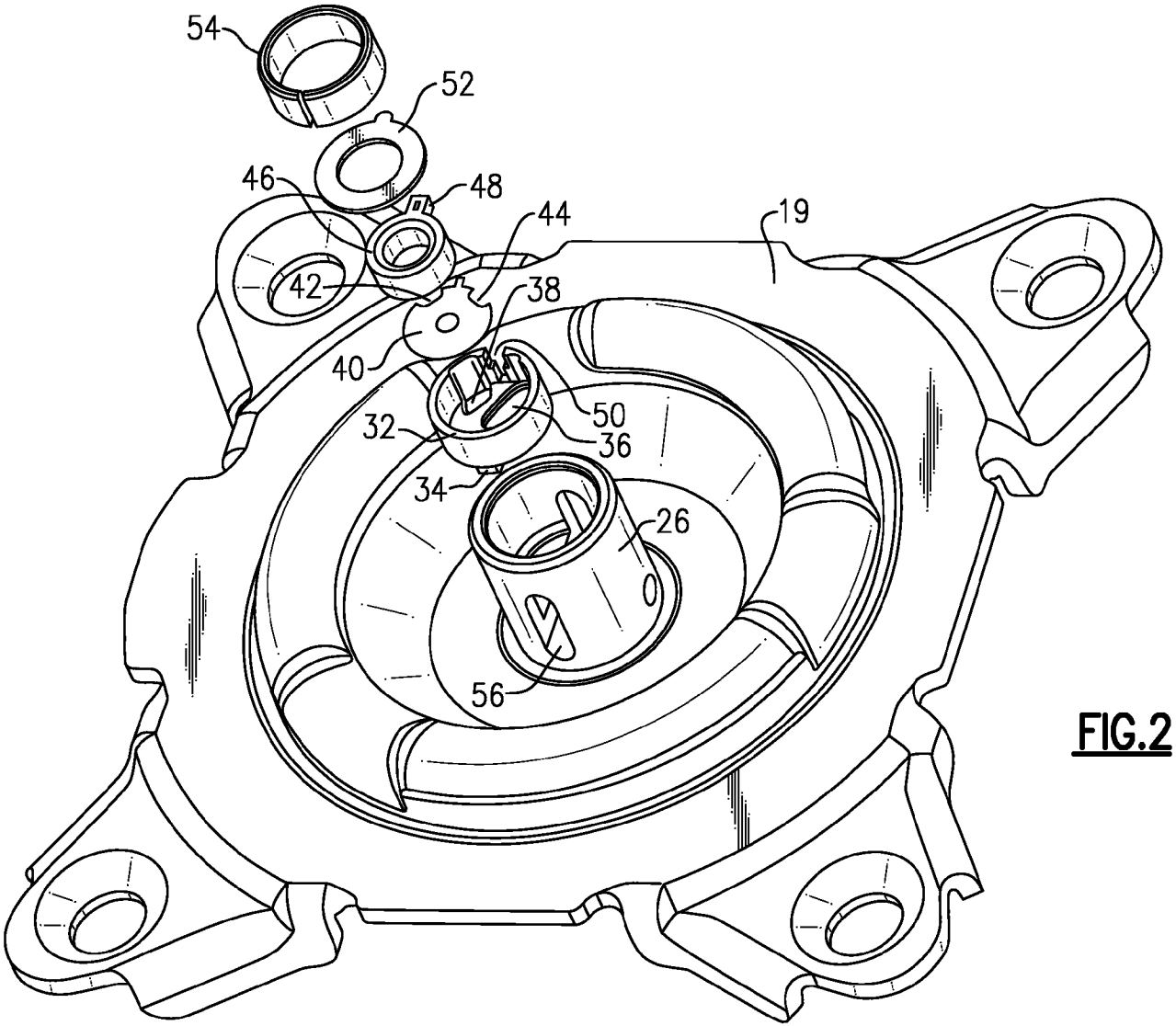
FIG. 2 is an exploded view of an oil pump and bearing assembly.
Figure 3:
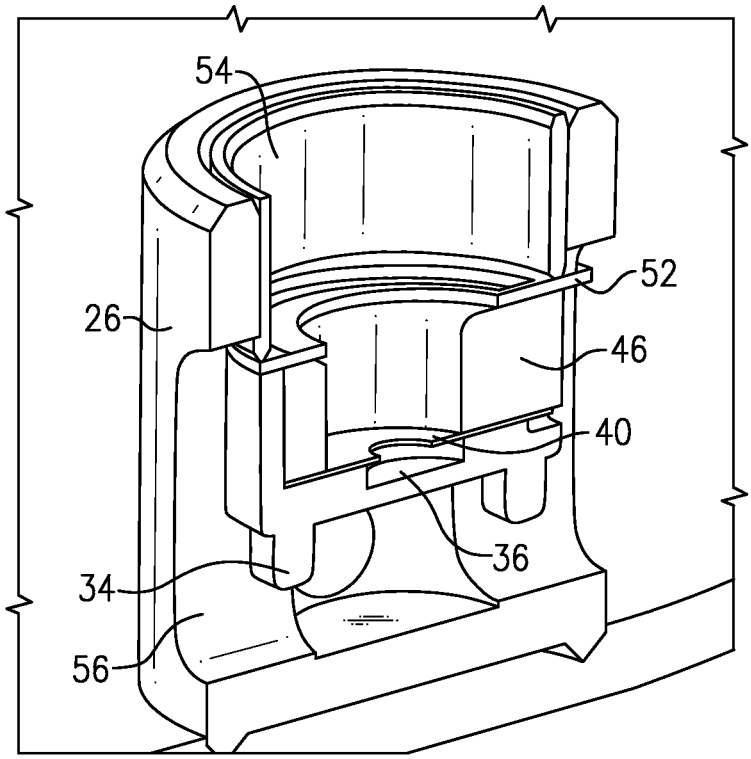
FIG. 3 shows the assembled components of FIG. 2.

FIG. 2 shows the inventive structure including a lower end cap 19 and the bearing housing 26 is in contact with, and secured to, the lower end cap 19 (see also FIG. 3). A pump housing 32 includes a leg 34 which fits into a slot 56 in the bearing housing 26. The housing 32 is also provided with an inlet flow passage 38, and a discharge passage 36. A cover plate 40 sits atop these passages, and includes a communication hole 44 for communicating oil from a discharge end of the pump to the passage 36. Another opening 42 on the cover plate 40 communicates with the suction opening 38 in the housing.

A rotary pump piston 46 including a vane 48 is received within a slot 50 in the housing. As known, the shaft 23 is provided with an eccentric drive to drive the rotary piston 46 within the pump housing 32, and move a pump fluid, here oil, from the inlet to the discharge.

A top plate 52 sits atop the piston 46, and encloses the pump chamber. A bearing 54 secures all of these components within the bearing housing 26, by means of press fit. The bearing is received in bearing housing 26 spaced towards the compressor pump unit 28 relative to the pump housing 32.

As shown in FIG. 3, the several components are assembled in order. The legs 34 sit within the slot 56. As can be appreciated, the discharge opening 36 communicates with the central passage 23 in the driveshaft 22.

As can be appreciated from FIG. 3, the assembly of the oil pump is quite simple. The housing 32 is initially placed within the bearing housing 26. The leg 34 serves to position and secure the housing. Next, the cover plate 40, pump piston 46, and cover plate 52 are all assembled. Finally, the bearing 54 secures all of these components together and in the bearing housing 26. Of course, the components can be assembled into preassembled components prior to being moved into the bearing housing. The bearing 54 also serves to support the shaft 22, as known. Also, cover plate 52 acts as a thrust bearing to support the shaft 22.

Figure 4:
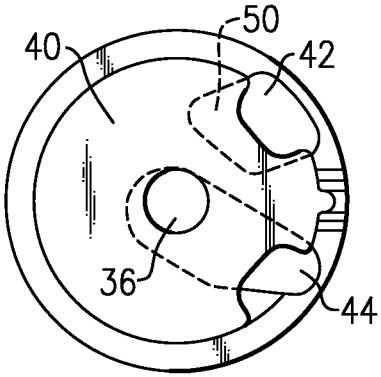
FIG. 4 shows flows passages within several components.

FIG. 4 shows how the suction inlet 42 will allow oil to move inwardly, and from the passage 50 into the pump chamber. The discharge opening 44 communicates with the groove 36, and eventually the center of the bushing, and into the passage 23 in the shaft.

Figure 5:
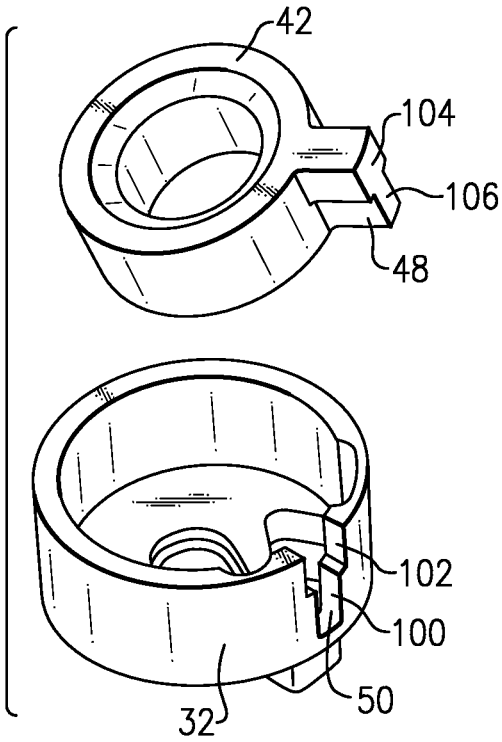
FIG. 5 shows pump components.

FIG. 5 shows another feature, wherein the housing slot 50 has a stepped section 100 and 102. As can be seen, the piston vane has its own step 104, 106.

The use of the stepped section ensures that the pump will be properly oriented when mounted within its housing.

Figure 6A:
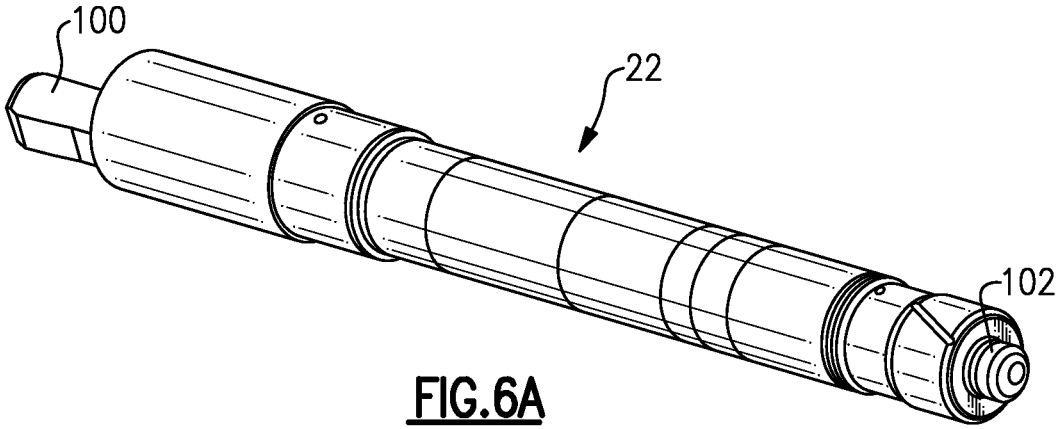
FIG. 6A shows a perspective view of a shaft for this compressor.
Figure 6B:
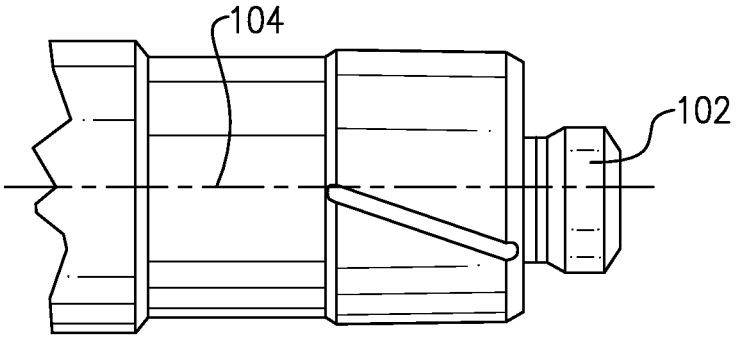
FIG. 6B shows a feature of the FIG. 6A shaft.

As shown in FIG. 6A, the shaft 22 has an eccentric pin 100 which will be received within structure in the orbiting scroll member, as known. An eccentric 102 at the other end drives the pump piston. As shown in FIG. 6B, the eccentric 102 is eccentric relative to a center drive axis 104 of the shaft 22, thus ensuring the pump will drive the piston within the pump housing to move oil.

As disclosed, the oil pump is easy to assemble. The prior art use of a plurality of screws and other fastenings has been eliminated.

The pump housing and piston can be injected-molded from an engineered plastic, or formed from other suitable materials. The top and bottom plates may be simple stampings.

While the invention is illustrated in a vertically extending compressor, the same ideas could be incorporated into a horizontally extending compressor. The terms "lower" or "upper" as utilized in this disclosure and in the claims should not be taken as limiting the orientation to vertically extending compressors. Rather, the term "lower" should be interpreted to mean "remote from the compressor pump unit" and thus would cover a similar structure in a horizontally extending compressor.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A sealed compressor comprising:

a lower end cap secured to a center shell, and defining a sealed chamber;

an electric motor received within said sealed chamber, said electric motor driving a shaft, said shaft driving a compressor pump unit; and a lower bearing housing in contact with said lower end cap and including a bearing for supporting said shaft, and an oil pump received within said bearing housing, said oil pump including a pump housing including one of a slot and a leg, with said bearing housing including the other of said slot and said leg, with said leg being received in said slot to position said pump housing within said bearing housing, said oil pump further including a piston to be driven by said shaft to drive lubricant from a sump in said sealed chamber into a passage in said shaft.

2. The sealed compressor as set forth in claim 1, wherein said leg is formed on said pump housing.

3. The sealed compressor as set forth in claim 2, wherein there are a pair of spaced legs received within a pair of spaced slots in said bearing housing.

4. The sealed compressor as set forth in claim 1, wherein said pump piston is an eccentrically driven piston having a vane received in a slot in said pump housing.

5. The sealed compressor as set forth in claim 4, wherein a lower plate is received between said piston and said pump housing, and said pump housing and said lower plate including flow passages for providing the lubricant into a suction chamber defined between said piston and said pump housing, and further passages communicating with a discharge portion of a pump chamber defined between said pump piston and said pump housing, and from said discharge portion into said passage within said shaft.

6. The sealed compressor as set forth in claim 1, wherein said compressor pump unit is a scroll compressor.

7. The sealed compressor as set forth in claim 1, wherein said bearing is received in said bearing housing at a location spaced toward the compressor pump unit relative to the pump housing.

8. A sealed compressor comprising:

a lower end cap secured to a center shell, and defining a sealed chamber;

an electric motor received within said sealed chamber, said electric motor driving a shaft, said shaft driving a compressor pump unit;

a lower bearing housing in contact with said lower end cap and including a bearing for supporting said shaft, and an oil pump received within said bearing housing, said oil pump including a pump housing including one of a slot and a leg, with said bearing housing including the other of said slot and said leg, with said lea being received in said slot to position said pump housing within said bearing housing, said oil pump further including a piston to be driven by said shaft to drive lubricant from a sump in said sealed chamber into a passage in said shaft; and said bearing is positioned on a remote end of said piston from said pump housing, and said bearing securing said oil pump within said bearing housing.

9. The sealed compressor as set forth in claim 8, wherein a top plate closes off pump chambers and is positioned between said pump housing and said bearing.

10. A sealed compressor comprising:

a lower end cap secured to a center shell, and defining a sealed chamber;

an electric motor received within said sealed chamber, said electric motor driving a shaft, said shaft driving an orbiting scroll member; and a lower bearing housing in contact with said lower end cap and including a bearing for supporting said shaft, and an oil pump, said oil pump received within said bearing housing, said oil pump including a pump housing including a leg, with said bearing housing including a slot, with said leg being received in said slot to position said pump housing within said bearing housing, said oil pump further including a piston to be driven by said shaft to drive lubricant from a sump in said sealed chamber into a passage in said shaft.

11. The sealed compressor as set forth in claim 10, wherein there are a pair of spaced legs received within a pair of spaced slots in said bearing housing.

12. The sealed compressor as set forth in claim 10, wherein said pump piston is an eccentrically driven piston having a vane received in a slot in said pump housing.

13. The sealed compressor as set forth in claim 12, wherein a lower plate is received between said piston and said pump housing, and said pump housing and said lower plate including flow passages for providing the lubricant into a suction chamber defined between said piston and said pump housing, and further passages communicating with a discharge portion of a pump chamber defined between said pump piston and said pump housing, and from said discharge portion into said passage within said shaft.

14. The sealed compressor as set forth in claim 10, wherein said bearing is positioned on a remote end of said piston from said pump housing, and said bearing securing said oil pump within said bearing housing.

15. The sealed compressor as set forth in claim 14, wherein a top plate closes off pump chambers and is positioned between said pump housing and said bearing.

16. The sealed compressor as set forth in claim 10, wherein said bearing is received in said bearing housing at a location spaced toward the compressor pump unit relative to the pump housing.

17. A method of assembling an oil pump in a sealed compressor comprising a lower end cap secured to a center shell, and defining a sealed chamber, comprising the steps of: (a) positioning a pump housing within a bearing housing on an end of a sealed compressor housing, said bearing housing in contact with said lower end cap, with a leg formed on one of said pump housing and said bearing housing, said leg being received in a slot in the other of said pump housing and said bearing housing;

(b) placing a pump piston within said pump housing; and (c) placing a bearing in said bearing housing on an outer side of said pump housing, said bearing securing said pump housing and said piston within said bearing housing.

* * * * *